US009925454B2

(12) United States Patent
Beaudoin et al.

(10) Patent No.: US 9,925,454 B2
(45) Date of Patent: Mar. 27, 2018

(54) GAMING APPARATUS WITH STATUS INDICATOR

(71) Applicant: FANTASY FLIGHT PUBLISHING, INC., Roseville, MN (US)

(72) Inventors: Jason Beaudoin, Minneapolis, MN (US); Christian T. Petersen, White Bear Lake, MN (US)

(73) Assignee: ASMODEE NORTH AMERICA, INC., Roseville, MN (US)

( * ) Notice: Subject to any disclaimer, the term of this patent is extended or adjusted under 35 U.S.C. 154(b) by 130 days.

(21) Appl. No.: 14/796,417

(22) Filed: Jul. 10, 2015

(65) Prior Publication Data

US 2016/0038839 A1 Feb. 11, 2016

Related U.S. Application Data

(60) Provisional application No. 62/035,052, filed on Aug. 8, 2014.

(51) Int. Cl.
*A63F 9/00* (2006.01)
*A63F 3/00* (2006.01)

(52) U.S. Cl.
CPC ..... *A63F 3/00697* (2013.01); *A63F 2003/00719* (2013.01); *A63F 2003/00826* (2013.01); *A63F 2003/00883* (2013.01)

(58) Field of Classification Search
None
See application file for complete search history.

(56) References Cited

U.S. PATENT DOCUMENTS 2,001,330 A 5/1935 McKeever
2,359,253 A * 9/1944 Silano ..... A63B 71/0672 116/225
3,200,517 A * 8/1965 Agostino ..... G09B 17/00 40/491
3,755,939 A * 9/1973 Denega ..... A63B 71/0672 116/224
3,947,040 A * 3/1976 Samuels ..... A63F 3/00697 273/288
5,398,418 A * 3/1995 Jones ..... G06G 1/0005 116/223
5,582,128 A 12/1996 Wollan et al.
6,899,332 B2 5/2005 Weisman
6,899,333 B2 * 5/2005 Weisman ..... A63F 3/00075 273/289
6,938,897 B1 9/2005 Napiorkowski
(Continued)

FOREIGN PATENT DOCUMENTS

EP 0850671 A2 7/1998

*Primary Examiner* — Seng H Lim
(74) *Attorney, Agent, or Firm* — Dorsey & Whitney LLP; Nathaniel P. Longley, Esq.

(57) ABSTRACT

An apparatus includes a base and a coupling member. The base is configured to position a game piece with respect to a gaming area, and the coupling member is configured to couple the game piece to the base. A status selector is provided to select a status of the game piece with respect to the gaming area, using an indicator extending from a first side to a second side of the base. A set of indicia are configured to be selectively displayed by positioning the indicator with respect to the first and second sides of the base, so that the selected status of the game piece is indicated.

18 Claims, 11 Drawing Sheets

(56) References Cited

U.S. PATENT DOCUMENTS

| | | | | |
|---|---|---|---|---|
| 8,678,874 | B2 * | 3/2014 | Gary | A63H 3/00 273/288 |
| 2005/0017450 | A1 | 1/2005 | Weisman et al. | |
| 2005/0023749 | A1 * | 2/2005 | Annis | A63F 3/00697 273/138.1 |
| 2005/0073098 | A1 | 4/2005 | Weisman | |
| 2005/0077676 | A1 | 4/2005 | Long et al. | |
| 2005/0167914 | A1 * | 8/2005 | Kenney | A63F 3/00697 273/242 |
| 2006/0055110 | A1 | 3/2006 | Weisman | |
| 2007/0018391 | A1 * | 1/2007 | Ishihara | A63F 3/00 273/255 |
| 2008/0048396 | A1 * | 2/2008 | Andersen | A63F 3/00 273/288 |
| 2013/0225034 | A1 * | 8/2013 | Martorell | A63F 9/0278 446/97 |
| 2014/0084542 | A1 * | 3/2014 | Ziran | A63F 3/00697 273/288 |

* cited by examiner

P247491.US.02

GAMING APPARATUS WITH STATUS INDICATOR

CROSS-REFERENCE TO RELATED APPLICATIONS

This application claims priority to U.S. Provisional Application No. 62/035,052, filed Aug. 8, 2014 and entitled GAMING APPARATUS WITH STATUS INDICATOR, which is incorporated by reference herein, in the entirety and for all purposes.

BACKGROUND

This disclosure relates generally to simulations and gaming, and specifically to a gaming or simulation apparatus with a movable base and status indicator. For example, the base may be configured to position a game piece, miniature, or other object with respect to an area, and to display a related status based on the gaming or simulation architecture.

Generally, gaming and simulations activities include, but are not limited to, miniature gaming, board and table games, war games, and roleplaying games. The miniatures category includes detailed figures for use in gaming and simulation scenarios, typically with broad, tactical-level architectures. Board games and table games can be defined as tabletop activities that utilize game pieces, pawns, tokens, and similar components on a variety of different playing surfaces. War games include both board game and miniatures-based examples. Roleplaying games (RPGs) can be considered a form of shared gaming or storytelling experience, in which both miniatures and other game pieces can be used.

Miniature figures and game pieces may be made of metal, plastic, paper, and composite materials, and can be painted or unpainted, or include printed designs. The designs themselves have a wide variety of forms, ranging from abstract tokens and other symbolic expressions of gaming entities, to detailed representational images of vehicles, characters and weapons, some with meticulous two and three-dimensional artwork. In particular, game pieces and miniatures encompass both symbolic and actual representations of historical, mythological, and fantasy or science fiction entities, for use in tabletop games, simulations, war games, role-playing games, and other activities. A base or pedestal structure can also be provided, in order to position the game piece or figure within a particular simulation or gaming area.

While tabletop gaming and miniatures may be considered recreational activities, they have a dedicated and demanding audience. Both the base apparatus and the game piece or miniature components are subject to significant design and manufacturing considerations, including not only overall quality, durability and cost, but also reproduction and scale accuracy, as well as player and user preferences within a particular game or simulation architecture. This architecture can also impose additional design requirements, particularly for features configured to indicate the corresponding status of the game piece or miniature.

SUMMARY

This disclosure relates to gaming or simulation apparatus, and corresponding methods of operation by a game player or other user. The apparatus includes a base and a coupling member. The base is configured to position a game piece or miniature with respect to a gaming area or simulation environment, and the coupling member is configured to couple the game piece to the base. A status selector is provided in the base, in order to select a status of the game piece with respect to the gaming area. For example, the status selector may include a binary or multi-state indicator extending through the base from a first side to a second side.

A set of indicia can be provided on the indicator, and configured to be selectively displayed by positioning the indicator with respect to the first and second sides of the base. The selected status of the game piece can thus be indicated or represented by the selectively displayed indicia. For example, at least one of the indicia representing the selected status may be selectively displayed on one side of the base, and at least one other indicia not representing the selected status may be selectively hidden or concealed on the other side of the base.

Methods of using the base apparatus include positioning a game piece or miniature with respect to the gaming area or simulation environment. Different game pieces can be selectively coupled to the base, for example using a post or other coupling structure to support the game piece in position. The game player (or other user) can then manipulate the status selector in the base, in order to display a selected status of the game piece. The status can be defined with respect to a set of gaming rules related to the gaming area, or based on a corresponding simulation architecture.

The status selector is manipulated by sliding or manually positioning an indicator, which extends through the base from a first side to a second side. For example, a sliding indicator can be manually positioned to selectively display at least one of the indicia, indicating the selected status of the game piece on either the first or second side of the base. At least one other index can be selectively concealed or hidden on the opposite side of the base, where the concealed index represents a different status, other than the one that was selected.

The base can be configured so that positioning the game piece and manipulating the status selector are performed in continuous fashion, with one hand. Two status selectors can also be provided, for example in a transverse configuration with a combination of binary and multi-state indicators. Different structures for coupling selected game pieces and miniatures to the base can also be provided, for example using a direct mount to the base, or a support structure with one end configured to support the game piece and the other end attached to the base.

In some applications, the status indicator can be manually positioned to selectively display a plurality of indicia on either side of the base, representing a comparative level of the selected status. Comparative levels or values can thus be allocated between the selected status and a complementary status of the game piece, for example by positioning the sliding indicator to selectively display at least one other indicia on the opposite side of the base, representing the corresponding value of the complementary status. In some applications, the comparative values represent a fixed total or aggregate value, which is available for apportionment between the selected and complimentary status indicators by manipulation of the sliding indicator with respect to the two sides of the base.

DETAILED DESCRIPTION

Figure 1:
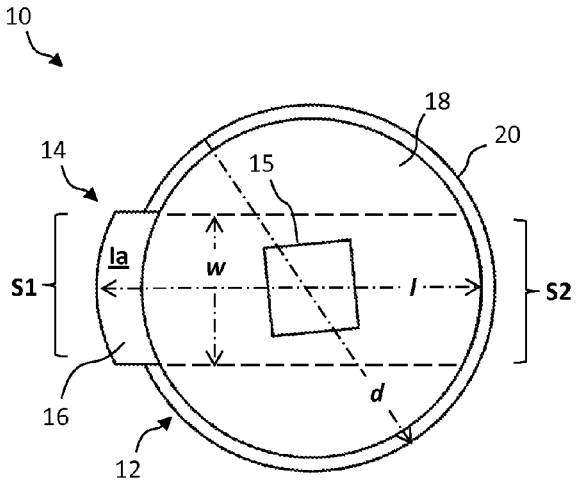
FIG. 1 is a top view of a gaming base or simulation apparatus, with movable base and status selector for use with a miniature or other game piece.

FIG. 1 is a top view of a gaming base or simulation apparatus 10, with movable base 12 and status selector 14 for a miniature or other game piece 15. As shown in FIG. 1, status selector 14 includes a manually positionable indicator 16, which is manipulated to selectively display index Ia on left side S1 of base 12. For example, index Ia may be visible on the top surface of a sliding indicator 16, as shown in FIG. 1, in order to represent the corresponding status of game piece 15 with respect to a gaming area or simulation environment.

Status indicator 16 extends into and through base 12 from a first (left or front) side S1 to a second (right or back) side S1, for example between upper portion 18 and lower portion 20 as shown by the dashed or hidden lines in FIG. 1. In this particular configuration, indicator 16 also has a substantially planar and oblong form, with width w substantially less than length l (that is, w<l). Length l is typically selected to be longer that the corresponding diameter d of base 12 (or similar width measurement), so that a portion of indicator extends outside base 12, in order to selectively display various indicia as described herein.

Figure 2:
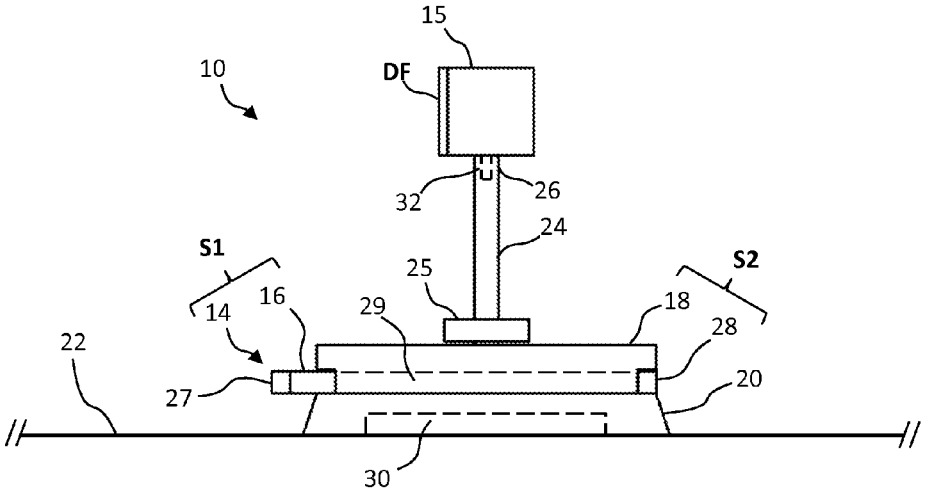
FIG. 2 is a side view of the apparatus, positioned on a gaming surface or simulation environment.

FIG. 2 is a side view of gaming or simulation apparatus 10, with base 12 positioned on a gaming surface or simulation environment 22. As shown in FIG. 2, game piece or miniature 15 is coupled to base 12 via a support post or other coupling structure 24. In this particular example, support 24 extends from a first (lower) end 25, coupled to upper portion 18 of base 12, to a second (upper) end 26, which is configured to support game piece 15 in position with respect to gaming or simulation area 22. Depending on embodiment, game piece 15 may also be supported in a particular orientation, for example with a front face or other directional feature DF oriented toward first side S1 of base 12.

Manual indicator 16 extends through base 12 between upper portion 18 and lower portion 20, for example with first end 27 oriented toward first side S1 and second end 28 oriented toward second side S2, opposing first side 27 on first side S1. A wide range of different indicia can be provided on indicator 16, using various colors, symbols, labels and markers on first and second ends 27 and 28. The indicia are selectively displayed by manual operation of status selector 14, positioning indicator 16 with first and second ends (or end portions) 27 and 28 extending alternately from first and second sides S1 and S2 of base 12.

Suitable materials for gaming apparatus 10 include, but are not limited to, plastics and other durable polymers, as well as metal, paper, wood, and composite materials. Depending on design, the individual components of base 12, selector 14, game piece 15 and support 24 can also be provided in either unitary or discrete form. For example, base 12 may be formed of a substantially unitary construction, e.g., from molded plastic, with indicator 16 extending through a channel or slot 29 formed between upper and lower base portions 18 and 20. Slot 29 extends from first side S1 of base 12 to second side S2 of base 12, and is dimensioned to accept a substantially planar indicator 16 with a rectangular cross section, as shown in FIG. 2. Alternatively, indicator 16 and channel 29 may have other geometries, for example with complementary round, oval, oblong, triangular, square, or multi-sided cross sections.

Channel 29 is formed in one or both of upper and lower base portions 18 and 20, which can be formed as a unit or coupled together to form base 12. Additional structures are also contemplated, for example a cavity or other stabilizing feature 30 in lower base portion 20, defining a generally circumferential footprint within the bottom perimeter of base 12. Alternatively, feature 30 may be formed with a metal weight or other stabilizing element.

Base 12 and support or coupling member 24 can also be provided in either unitary or discrete form, for example with the bottom end or lower portion 25 of support 24 coupled to upper base portion 18, as described above. The top end or upper portion 26 of support 24 can be configured to support different game pieces or miniatures, for example using a pin, post or other coupling structure 32 to couple and decouple a selected game piece 15. Alternatively, support 24 may be provided as an integral component of the game piece or miniature 15, which is swapped in and out of different bases 12 by coupling and decoupling lower end 25 of support 24.

Figure 3:
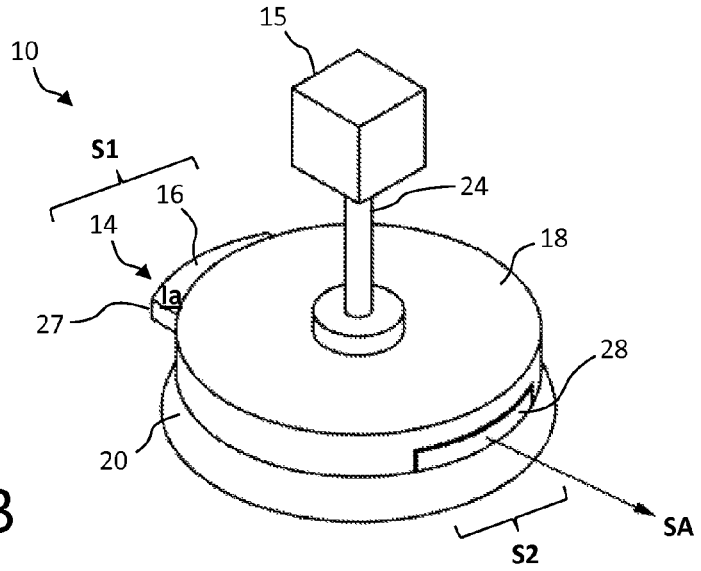
FIG. 3 is a perspective view of the apparatus, illustrating manipulation of the status selector in a first position.

FIG. 3 is a perspective view of gaming apparatus 10, illustrating manipulation of status selector 14. Status selector 14 includes a manual or sliding indicator 16, extending from first side S1 to second side S2 of base 12, as described above.

As shown in FIG. 3, status selector 14 is positioned in a first state or position in which indicia are selectively displayed on first end 27 of indicator 16. In this position, first end 27 extends from first side S1 of base 12, with the selected index or indicia Ia visible on the upper, lower and/or side surfaces of indicator 16. Other indicia on second end 28 of indicator can be positioned at least partially within base 12, and selectively concealed or hidden from view.

In some designs, one or both of ends 27, 28 of indicator 16 may be provided with a rounded or other conformal configuration, matching the corresponding outer surfaces of base 12 along sides S1 and S2. In these configurations, the "de-selected" end of indicator 16 can be positioned flush with the corresponding side of base 12, for example with second end 28 of indicator 16 substantially conforming to the outer surface of base 12 along corresponding second side S2, as shown in FIG. 3. Status selector 14 can also be manipulated into a second state by sliding, moving, or otherwise positioning indicator 16 along selector axis SA (see arrow), so that second end 28 extends from second side S2 of base 12 as shown in FIG. 4.

Figure 4:
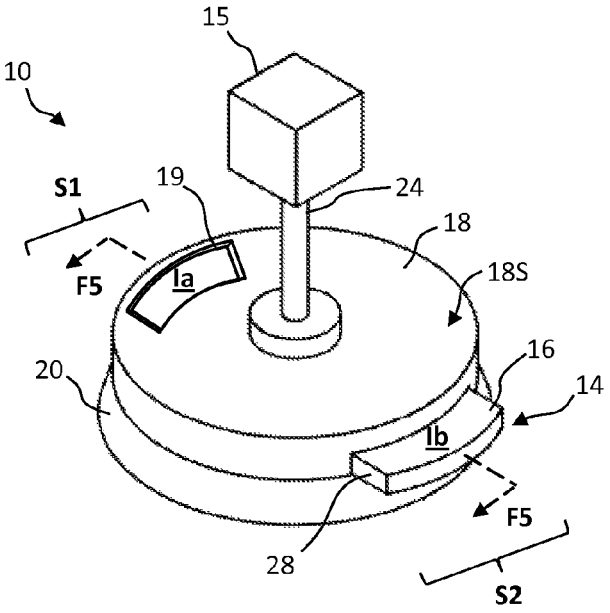
FIG. 4 is a perspective view of the apparatus, showing the status selector in a second position.

FIG. 4 is a perspective view of gaming apparatus 10, showing status selector 14 in a second state or position. In this position, index or indicia Ib may be selectively displayed on the upper, lower and/or side surfaces of indicator 16 at second end 28, extending from top and bottom portions 18 and 20 of base 12 on second side S2. Corresponding indicia on first end 27 of indicator 16 can be positioned at least partially within base 12, and selectively concealed or hidden from view.

Support 24 is configured to support game piece 15 in a particular position with respect to the game area or simulation environment, for example above base 12, in a position that is visible from both sides S1 and S2. Thus, the position of game piece 15 is readily observable, simultaneously with the corresponding status indicated by selector 14. When selector 14 is manipulated between the first and second states, one or more indicia on either end of indicator 16 can thus be selectively displayed on one side of base 12, while one or more indicia on the other end can be selectively concealed or hidden from view on the opposite side.

Multi-state as well as binary selectors 14 are also contemplated. In these configurations, selector 14 can be manipulated to position indicator 16 in an intermediate state, in which selected indicia are at displayed or least partially visible on both first end 27 of indicator 16, along first side S1 of base 12, and also (simultaneously) on second end 28, along second side S2. At the same time, one or more other indicia can be selectively concealed or hidden from view, on either or both of ends 27 and 28, and on either or both of sides S1 and S2.

One or more display windows 19 may also be provided in base 12, for example in top surface 18S of upper base portion 18. As shown in FIG. 4, display window or windows 19 provide for selective display of various indicia Ia, where the corresponding portion of indicator 16 on which indicia Ia appears is exposed and visible on the top of base 12. Thus, one or more indicia Ia may be selected for display or concealment on either the top or sides of base 12, or both, based on the location of indicia Ia and the corresponding position of indicator 16 with respect to sides S1 and S2.

Depending on the form of such indicia Ia, and other design considerations, such display windows 19 may also have various geometric configurations, including, but not limited to, square, round, circular, oval, arcuate, oblong, rectangular, triangular, trapezoidal, and multi-sided, with either straight or tapered sides extending from top surface 18S into upper portion 18 of base 12. In addition, one or more display windows 19 may be formed with a perimeter entirely within top surface 18S of upper base portion 18, as shown in FIG. 4, or with one or more open sides extending to the perimeter of upper base portion 18.

Figure 5:
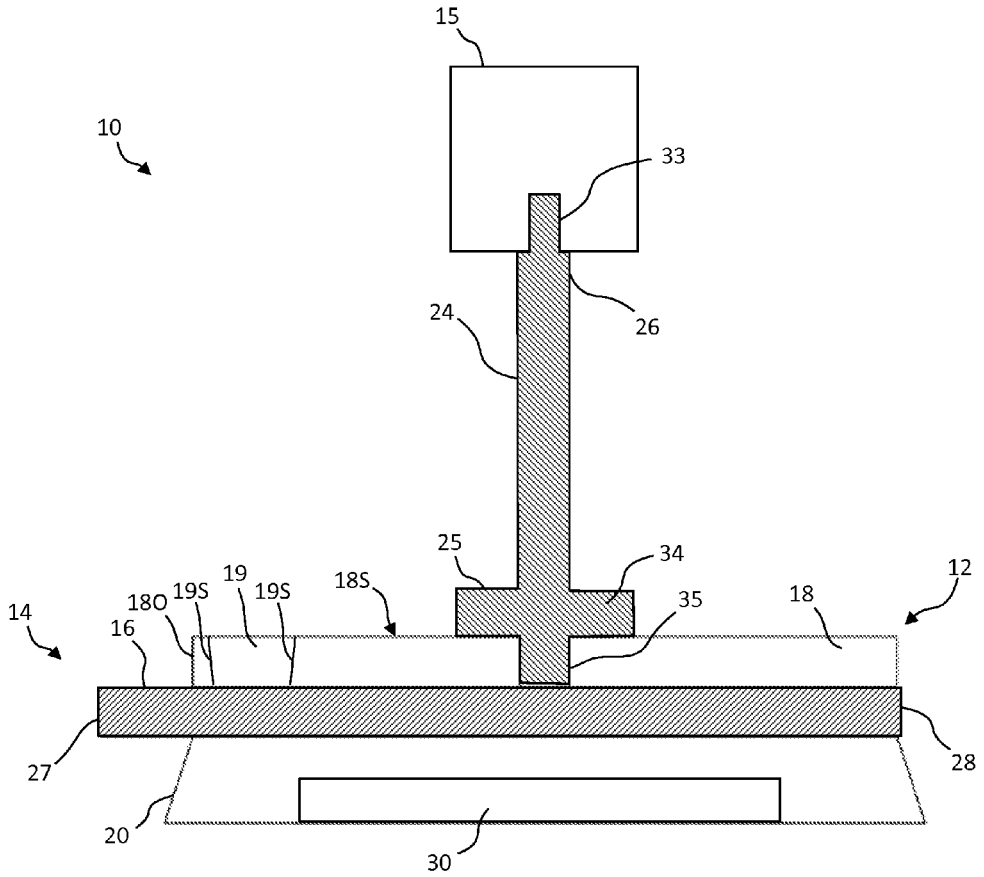
FIG. 5 is a cross-sectional view of the apparatus, taken along line F5-F5 of FIG. 4.

FIG. 5 is a cross-sectional view of gaming apparatus 10, taken through base 12 and support 24 along line F5-F5 of FIG. 4. As shown in FIG. 5, lower portion 20 of base 12 may be formed separately from upper portion 18, for example using a plastic or polymer lower portion 20 with a cavity, metal weight or other stabilizing feature 30. Upper portion 18 can be formed of similar materials, or from a paperboard or other printable material printed with a logo, indicia, symbols, markers or other information on top surface 18S.

Lower end 25 of support 24 is coupled to base 12, for example with a post or platform structure 34 inserted into a corresponding aperture or hole 35 in upper base portion 18. Different game pieces or miniatures 15 can thus be selected for use with base 12 by decoupling and coupling support 24 at lower (bottom) end 25. Alternatively, selected game pieces or miniatures 15 can be swapped in and out of coupling engagement with upper (top) end 26 of support 24, for example using an internal post or pin arrangement 33 as shown in FIG. 5, or using a platform or other similar coupling structure 34, as shown for lower end 25.

One or more display openings or windows 19 may also be provided, as described above with respect to FIG. 4. In this particular example, display opening or window 19 has tapered sides 19S extending through upper portion 18 of base 12, and is configured to expose one or more indicia on indicator 16, with the indicia selectively displayed on or visible through top surface 18S of base 12. Alternatively, sides 19S of display window 19 may be straight or have a different configuration.

Window 19 may also be open (empty), or a clear or transparent plastic or glass component may be provided, through which the selected indicia are visible on selector 16. One or more sides of window 19 may also extend to outer perimeter 180 of upper portion 18 of base 12, so that the perimeter of window 19 is open on one or more sides. Alternatively window 19 may have a closed perimeter; that is, with the sides and perimeter entirely disposed or enclosed within upper surface 18S of base 12.

Figure 6:
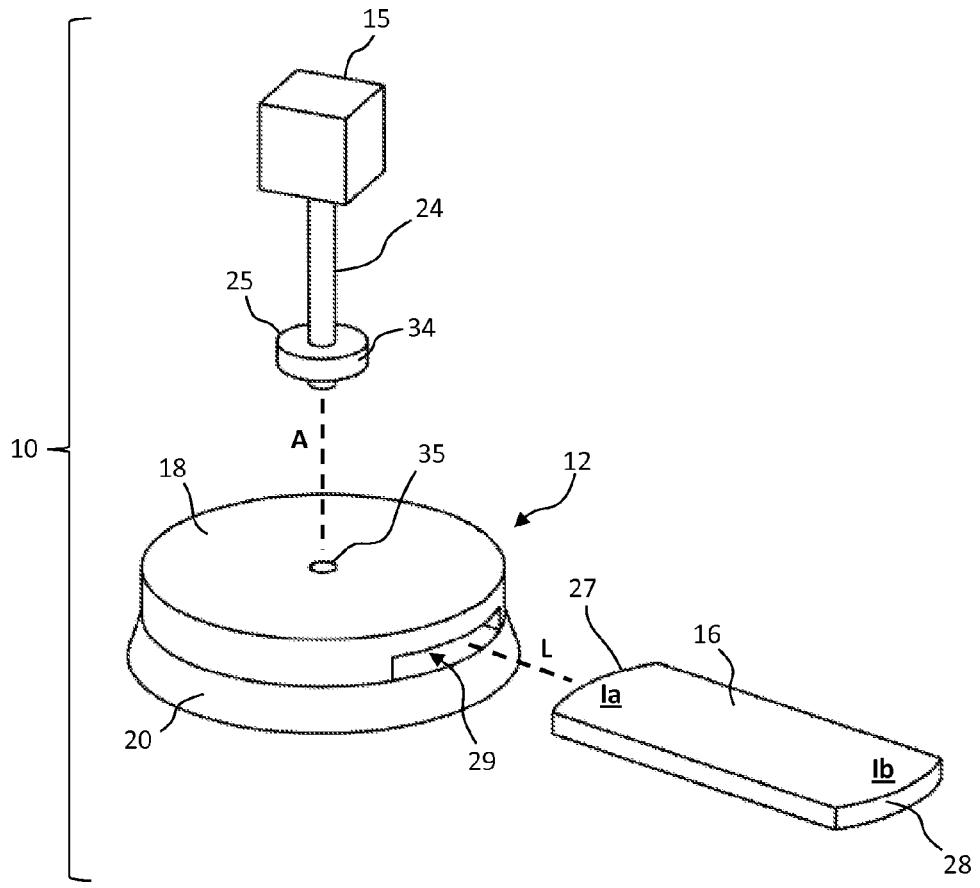
FIG. 6 is an exploded or partially disassembled view of the apparatus in FIGS. 1-5, showing the base, status indicator and game piece support.

FIG. 6 is an exploded or partially disassembled view of gaming apparatus 10, showing base 12, status indicator 16 and support 24 for a miniature or other game piece 15. As shown in FIG. 6, game piece 15 is coupled to base 12 by attaching lower end 25 of support 24 to upper portion 18 of base 12. For example, coupling structure 34 may be inserted into an aperture or other mating structure 35, as defined along perpendicular or vertical axis A. Indicator 16 is inserted into slot or channel 29 in base 12, along horizontal or longitudinal axis L.

In one particular embodiment, base 12 is formed as a unitary structure, with channel 29 extending through base 12 between upper portion 18 and lower portion 20. Alternatively, channel 29 may be formed in one or both of upper base portion 18 and lower base portion 20, with upper and lower portions 18 and 20 assembled to form base 12.

Figure 7:
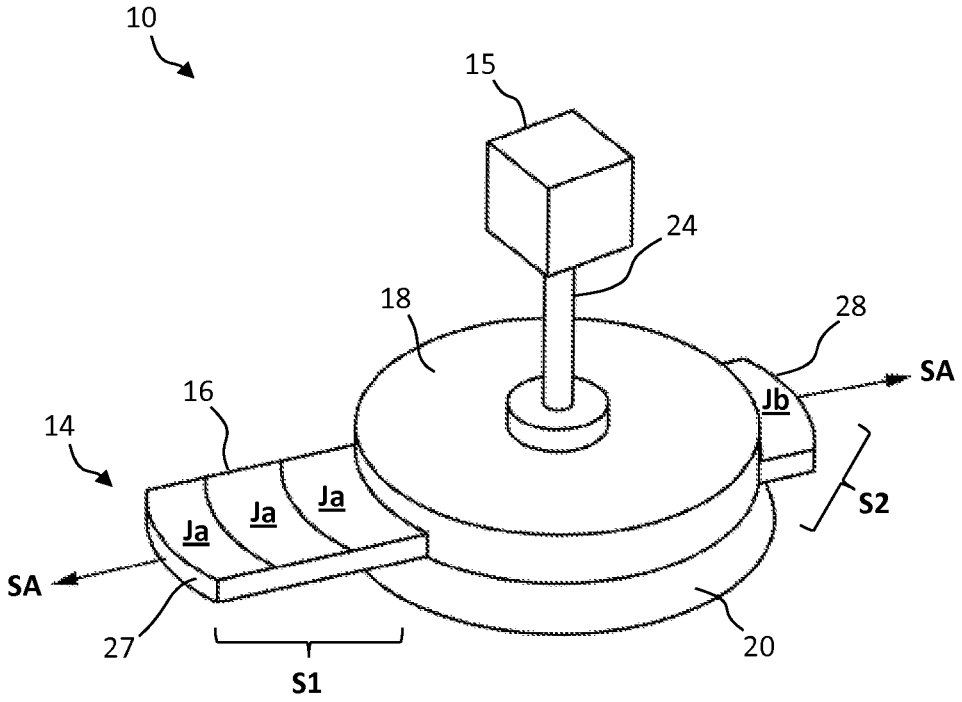
FIG. 7 is a perspective view of the apparatus, in an embodiment with a multi-state status indicator.

FIG. 7 is a perspective view of gaming apparatus 10, in an embodiment with multiple indicia Ja and Jb provided on indicator 16. As shown in FIG. 7, status selector 14 can be manipulated to slide or move indicator 16 in either sense along selector axis SA, in order to selectively display and conceal multiple indicia Ja and Jb on one or both ends 27 and 28. Depending on the selected position of indicator 16, zero, one or more status indicia Ja may be selectively displayed on first side S1 of base 12, and zero, one or more indicia Ja may be selectively hidden or concealed. Similarly, zero, one or more status indicia Jb may be selectively displayed on second side S2 of base 12, and zero, one more or indicia Jb may be selectively hidden or concealed.

The number and other characteristics of the individual indicia can be adapted to particular gaming architectures and simulation environments. In binary embodiments, for example, single indicia Ia and Ib may be provided on each end of indicator 16, in order for status selector 14 to toggle between complementary states such as active/inactive or moved/unmoved. The indicia may also describe other more general binary attributes such as stationary, holding, firing, cloaked, hidden, visible, or pending other action (e.g., awaiting an opportunity attack or other conditional action).

In multi-state embodiments, comparative values or qualitative degrees may be indicated by selectively displaying and concealing complementary status indicators Ja and Jb on opposite ends 27 and 28 of a particular indicator 16. For example, status selector 14 may be manipulated to position indicator 16 in order to represent allocation of power or energy between forward and rear defenses or shields, represented on (e.g., front) side S1 and (back) side S2 of base 12, respectively. More generally, indicator 16 can also be positioned to allocate available status levels or comparative values between different types of offensive and defensive systems (e.g., different shields or weapons systems), or between different system types (e.g., offensive, defensive, and engineering systems such as engine speed or movement points).

In these examples, conservation principles can be applied so that a predetermined or preselected value of comparative levels are available for allocation on indicator 16. Thus, the number of indicia Ja and Jb displayed either side S1 and S2 of base 12 may sum to a corresponding fixed value, or the selected indicia may otherwise represent the total available comparative value. For example, indicia Ja and Jb may all have a substantially similar or fixed length along actuator axis SA (or along longitudinal axis L, see FIG. 6), with color coding or alphanumeric indicia to represent allocation between a selected system status indicated at first end 27 of indicator 16 (on first side S1 of base 12), and a complementary system status indicated at second end 28 (on second side S2).

Alternatively, various indicia Ja and Jb on different ends 27 and 28 of indicator 16 may provide for different comparative values or qualitative levels, depending on gaming or simulation architecture. For example, indicia Ja on first end 27 of indicator 16 may have different axial lengths from corresponding indicia Jb on second end 28, in order to indicate different status levels or degrees depending upon how the corresponding points or simulation resources are allocated (e.g., with different total comparative values depending upon how power or energy is allocated to different shields and weapons systems, or among different offensive, defensive and movement systems).

Figure 8:
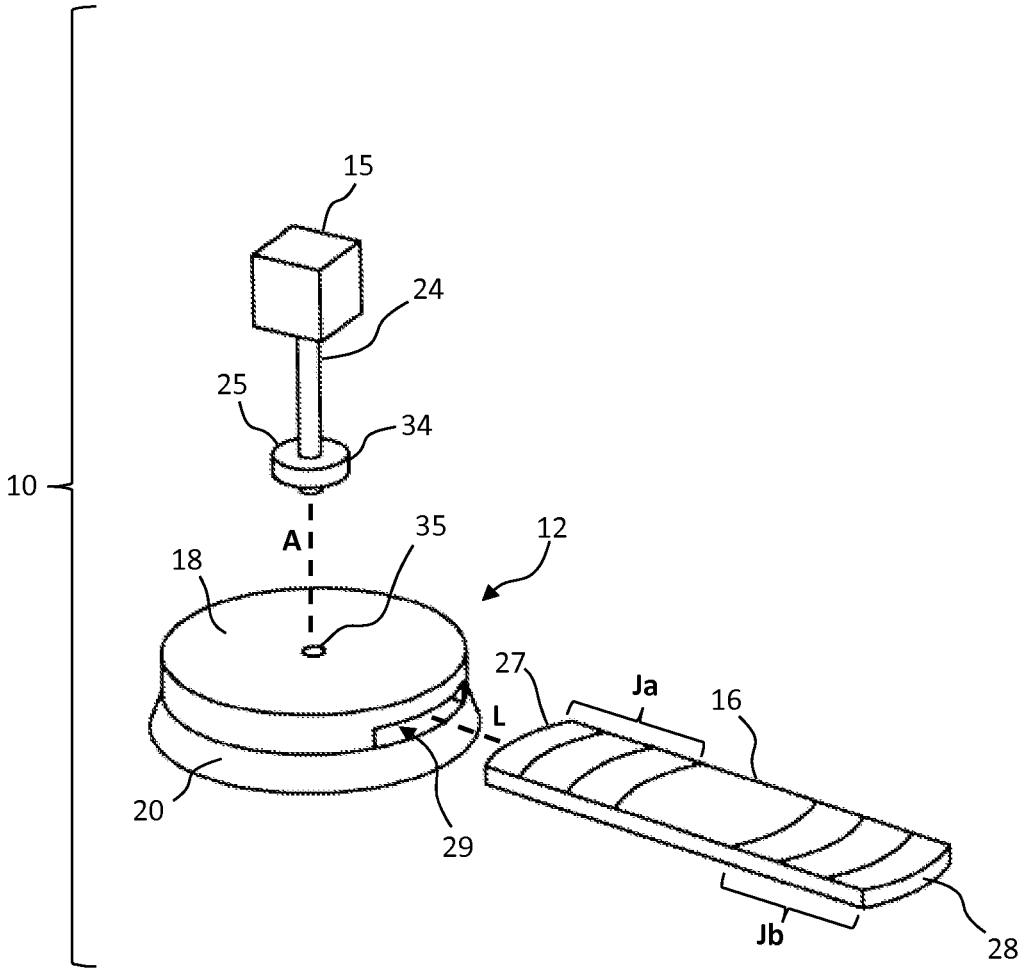
FIG. 8 is a partially disassembled view of the apparatus in FIG. 7, showing the base and multi-state status indicator.

FIG. 8 is a partially disassembled view of simulation or gaming apparatus 10, showing base 12 and multi-state indicator 16. Game piece or miniature 15 is coupled to base 12 by attaching lower end 25 of support 24 to upper portion 18, for example by inserting coupling structure 34 into mating aperture 35 along vertical axis A. Indicator 16 has multiple indicia Ja and Jb distributed on first and second ends 27 and 28, and is inserted into base 12 via a slot or channel 29 oriented along longitudinal axis L.

Figure 9:
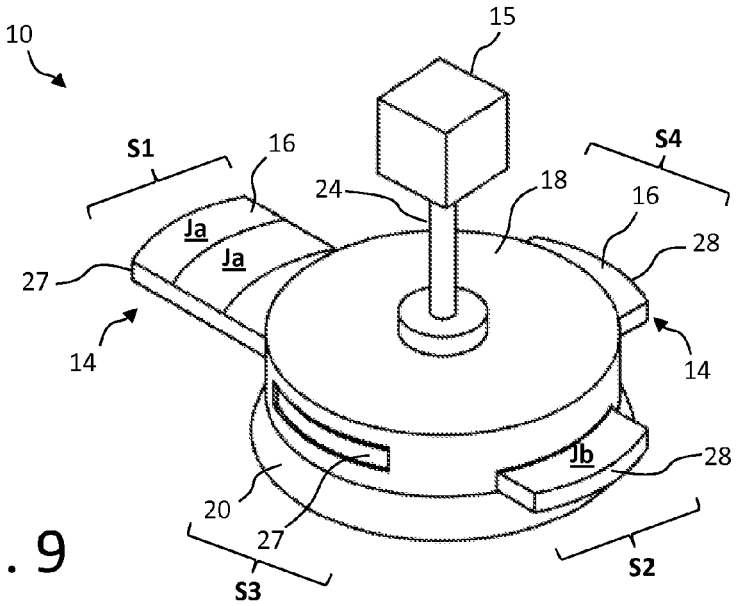
FIG. 9 is a perspective view of the apparatus, in an embodiment with transversely oriented status selectors in binary and multi-state configurations.

FIG. 9 is a perspective view of gaming apparatus 10, in an embodiment with transversely oriented status selectors 14. As shown in FIG. 9, a first (e.g., multiple-state) selector 14 has a plurality of individual indicia Ja and Jb on first and second ends 27 and 28 of indicator 16, configured for selectively display and concealment on the front (first) side S1 and back (second) side S2 of base 12, respectively.

A second (e.g., binary) status selector 14 is positioned with first end 27 of selector 16 substantially flush along third side S3 of base 12, in order to selectively display an individual index on opposite side S4. The two (or more) status selectors 14 are transversely oriented, with binary indicator 16 extending through base 12 from the left (third) side S3 to the right (fourth) side S4, in transverse orientation with respect to multi-state indicator 16 extending between first and second sides S1 and S2. One, two or more display windows may also be provided to selectively display and/or conceal indicia on one or both indicators 16, for example as described above with respect to FIGS. 4 and 5.

Figure 10:
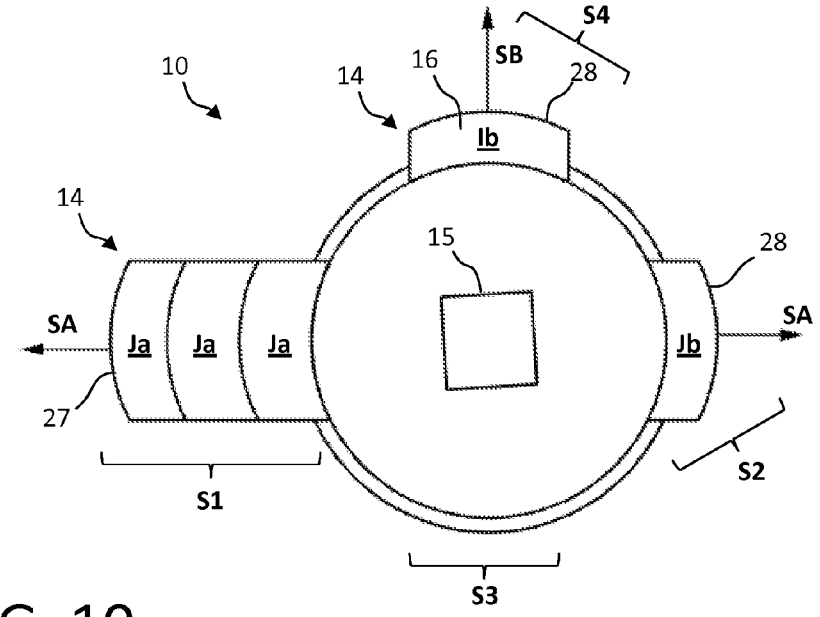
FIG. 10 is a top view of the apparatus in FIG. 9, illustrating manipulation of the transversely oriented status selectors.

FIG. 10 is a top view of gaming apparatus 10, illustrating manipulation of the transversely oriented status selectors 14. As shown in FIG. 10, the first status selector 14 is manipulated to position a multi-state indicator 16 in either direction along axis SA (e.g., by sliding), in order to selectively display and conceal one or more indicia Ja and Jb on each end 27 and 28. The second status selector 14 is manipulated to position binary indicator 16 along transversely oriented axis SB, for example with selected index Ib displayed on second end 28, extending out past side S4 of base 12.

Figure 11:
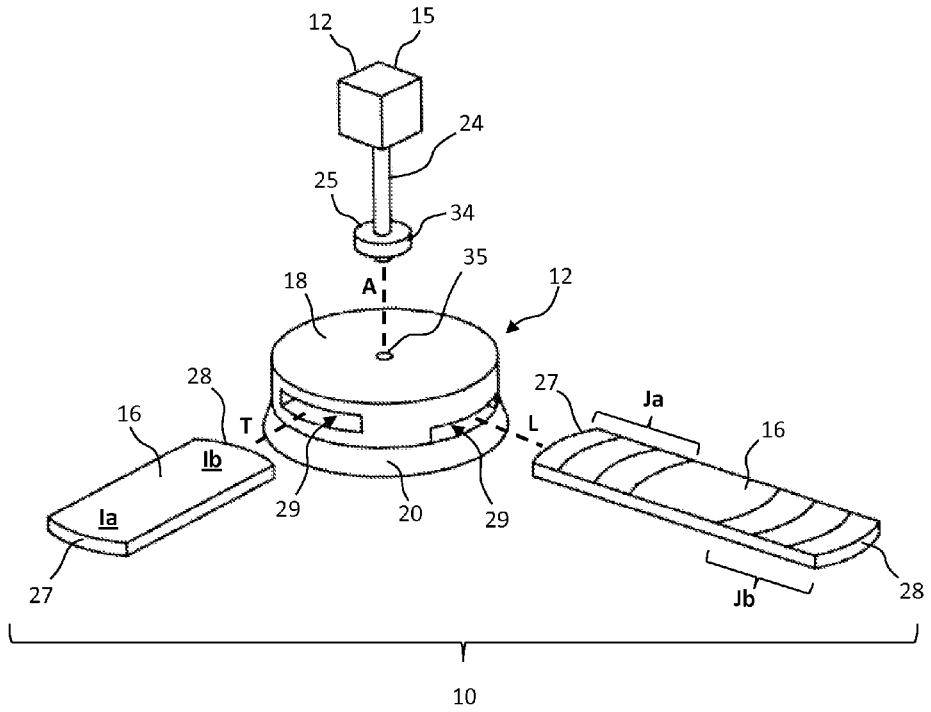
FIG. 11 is a partially disassembled view of the apparatus in FIGS. 9 and 10, showing the transversely oriented status indicators.

FIG. 11 is a partially disassembled view of simulation or gaming apparatus 10, showing base 12 and transversely oriented status indicators 16. Game piece 15 is coupled to base 12 by attaching lower end 25 of support 24 to upper portion 18 of base 12, for example by inserting coupling structure 34 into mating structure 35 along vertical axis A.

Indicator 16 has multiple indicia Ja and Jb at each end 27 and 28, and is inserted into a slot or channel 29 extending through base 12 along longitudinal axis L. For example, longitudinal axis L may be oriented substantially perpendicular or transverse to vertical axis A, as shown in FIG. 11. Binary indicator 16 has individual indicia Ia and Ib at each end 27 and 28, and is inserted into a slot or channel 29 extending through base 12 along transverse axis T. For example, transverse axis T may be oriented substantially perpendicular or transverse to longitudinal axis L, with longitudinal and transverse axes L and T defining a horizontal plane, substantially perpendicular to vertical axis A.

Figure 12:
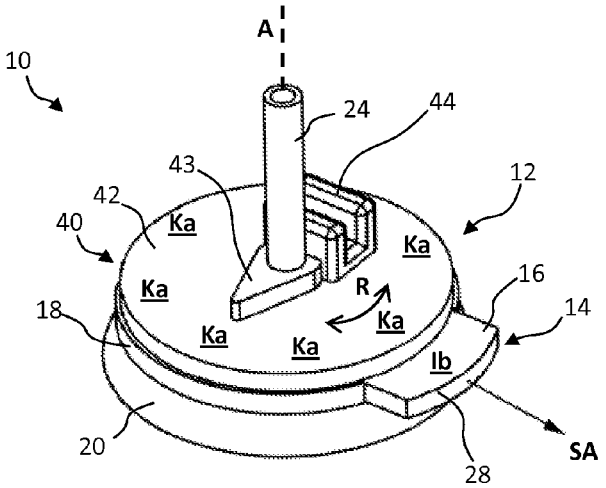
FIG. 12 is a perspective view of the apparatus, in an embodiment with a rotary display.

FIG. 12 is a perspective view of gaming apparatus 10, in an embodiment with rotary display 40. As shown in FIG. 12, status selector 14 is manipulated to position indicator 16 along axis SA in order to selectively display one or more status-related indicia, for example with selected index Ib visible on second end 28 of indicator 16. Display 40 is configured to selectively indicate additional indicia Ka on a disk or other display surface 42, for example using a pointer or other indicator 43, coupled to support 24.

Suitable materials for display 42 include, but are not limited to, plastic and other printable materials such as paper and paperboard. Indicia Ka on display 42 provide additional status information relating to the game piece or miniature, for example offensive or defensive strength, or other information such as energy, power, or level, as defined within a particular gaming architecture or simulation environment. A token holder 44 may also be provided, and configured to hold or support a token or additional game piece indicating additional status information. For example, token holder 44 may be coupled to one or both of support 24 and pointer 43, and configured to hold a token representing cargo, or a passenger, commander or other gaming entity carried on or with the game piece.

In the particular configuration of FIG. 12, display 42 is rotatable about vertical axis A with respect to base 12 (arrow R), in order to position selected indicia Ka with respect to pointer 43. Alternatively, display 42 may be rotationally fixed with respect to base 12, and pointer 43 may be configured to rotate about axis A with respect to selected indicia Ka. Depending on design, either display 42 or pointer 43 may thus be configured for rotation about support 24, or pointer 43 and support 24 may be configured for co-rotation within display 42.

Figure 13:
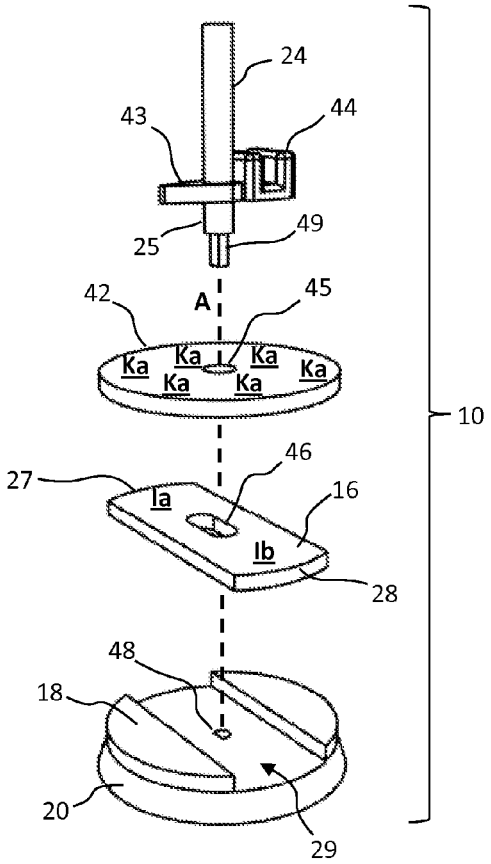
FIG. 13 is a partially disassembled view of the apparatus in FIG. 12, showing the status indicator in a slotted configuration.

FIG. 13 is a partially disassembled view of gaming apparatus 10, showing status indicator 16 in a slotted configuration. As shown in FIG. 13, apparatus 10 may be assembled with indicator 16 inserted into a slot or channel 29 formed in upper portion 18 of base 12, with rotary display 42 positioned above status indicator 16, on top of upper base portion 18.

The lower end (or bottom portion) 25 of support 24 is inserted through a hole or aperture 45 in rotary display 42, extending through slot 46 in status indicator 16 and into aperture 48 in lower portion 20 of base 12. Slot 46 is dimensioned to allow for indicator 16 to slide back and forth in channel 29, while retaining indicator 16 within base 12 when the post or pin structure on the lower portion 25 of support 24 contacts or abuts either end of slot 46.

In particular, slot 46 is dimensioned to limit motion of indicator 16 with respect to the sides of base 12, when the pin or post structure on lower portion 25 of support 24 contacts the ends of slot 46. Alternatively, a similar pin or post structure 25 may be provided independently of support 24.

In the particular configuration of FIG. 13, a keyed structure 49 is utilized on lower portion or pin 25 in order to align support 24 with respect to base 12, and to prevent relative rotation of support 24 and base 12. Keyed structure 49 on pin 25 extends down through slot 46 in indicator 16, and into the complementary opening or keyed aperture 48 in base 12. Alternatively, a rotational coupling may be provided between pin 25 and mating aperture 48, so that support 24 rotates about axis A with respect to base 12.

In the particular embodiment of FIG. 13, support 24, pointer 43 and token holder 44 are provided in unitary form, for example using a molded thermoplastic or other polymer material. Similarly, upper and lower portions 18 and 20 of base 12 may also be formed as a unitary structure, for example from a molded plastic or polymer with channel 29 defined in upper base portion 18.

Alternatively, any of support 24, pointer 43, token holder 44, and upper and lower (or top and bottom) base portions 18 and 20 may be formed of plastics, polymers, paper, paperboard and other suitable materials, and provided in either discrete (separate) or unitary (integrated) form. Channel 29 may also be open at the top of base 12 in order to receive indicator 16 along vertical axis A, as shown in FIG. 13, or closed at the top, as shown in FIGS. 1-11.

Figure 14:
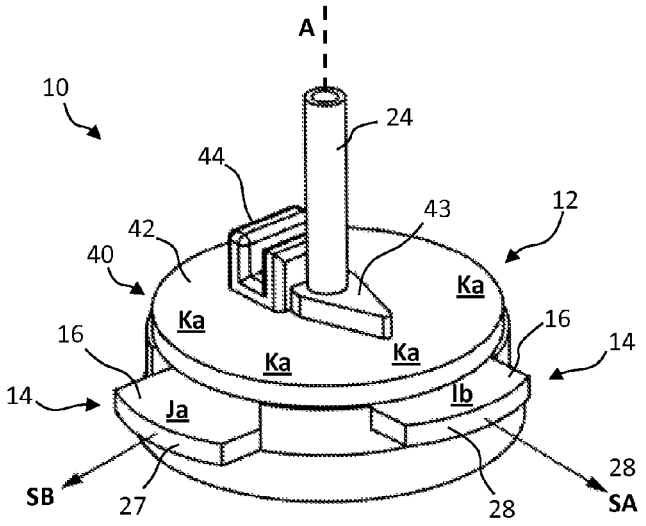
FIG. 14 is a perspective view of the gaming apparatus, in an embodiment with a rotary display and transversely oriented status selectors.

FIG. 14 is a perspective view of gaming apparatus 10, in an embodiment with display 40 and transversely oriented status selectors 14. As shown in FIG. 14, a first (e.g., binary) status selector 14 is configured to position indicator 16 along axis SA, in order to selectively display one or more status-related indicia such as index Ib on second end 28. A second (e.g., multi-state) status selector 14 is configured to position a second indicator 16 along transverse axis SB, in order to selectively display and conceal multiple status-related indicia such as indicia Ja on first end 27. Alternatively, two or more multi-state or binary status selectors 14 may be used, in any combination, and the relative positions of the corresponding indicators 16 can be interchanged without loss of generality.

In the particular embodiment of FIG. 14, selector axes SA and SB are substantially transverse and perpendicular; that is, at approximately right angles with respect to one another. Alternatively, selector axes SA and SB may be skew. Suitable transverse and skew angles depend upon the width of the status indicators 16, as compared to the circumferential perimeter of base 12. For example, skew angles of at least 30° or at least 45° and up to about 90° may be suitable, in order for the selected indicia on both indicators 16 to be visible at the same time, without overlapping the crossed indicators 16 outside the perimeter of base 12.

Figure 15:
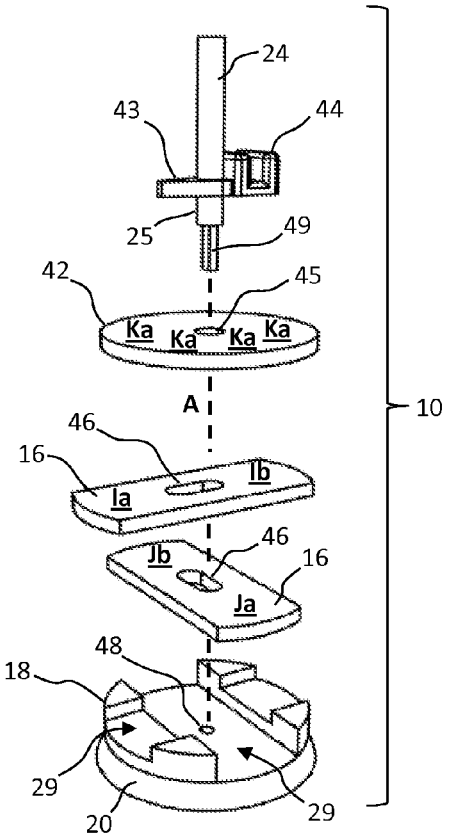
FIG. 15 is a partially disassembled view of the apparatus in FIG. 14, showing the transversely oriented status indicators.

FIG. 15 is a partially disassembled view of gaming apparatus 10, showing transversely oriented status indicators 16. Note that FIG. 15 is rotated by approximately 90° with respect to FIG. 14, clockwise about assembly axis A.

As shown in FIG. 15, a first (e.g. multi-state) indicator 16 is inserted into first slot or channel 29 formed in lower portion 20 of base 12, and a second (e.g., binary) indicator 16 is inserted into a second transverse channel 29 formed in upper portion 18. Alternatively, one or both channels or slot structures 29 may be formed in either upper portion 18 or lower portion 20 of base 12.

Display 42 is positioned over the second (top) indicator 16, above or on top of upper portion 18 of base 12. The post or pin structure on lower portion 25 of support 24 is inserted through aperture 45 in display 42, extending along vertical axis A through slots 46 in transversely oriented status indicators 16. Key structure 49 is inserted into corresponding aperture 48 in lower portion 20 of base 12, in order to prevent misalignment or rotation of support 24 as described above.

Figure 16:
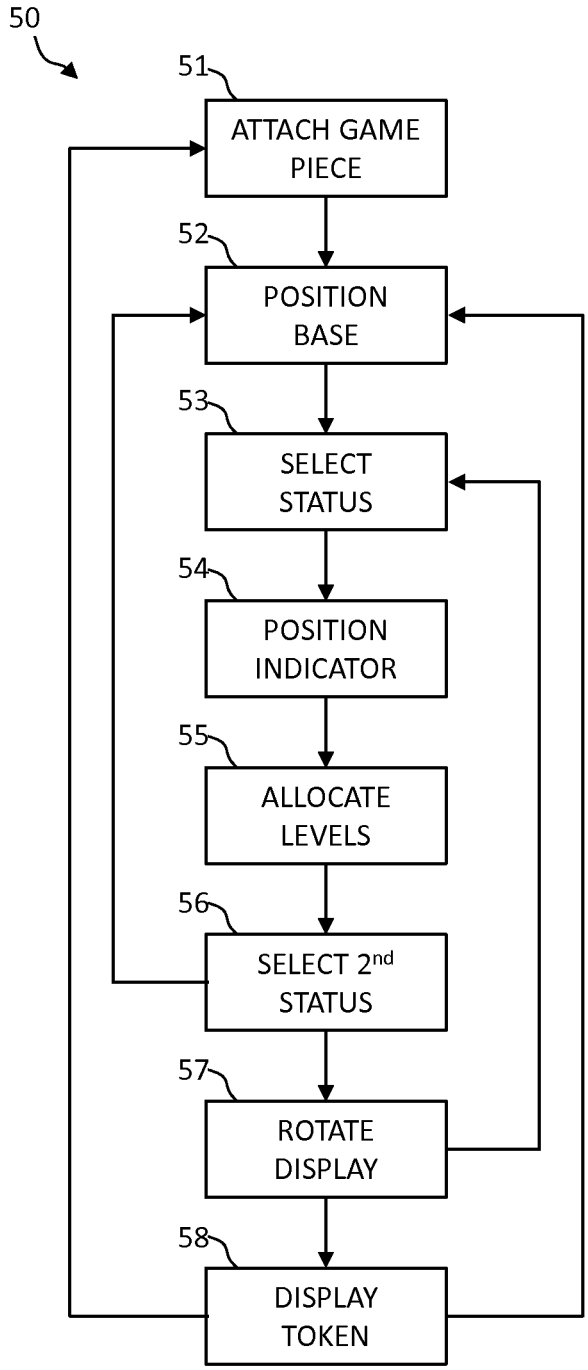
FIG. 16 is a block diagram of a method for using the apparatus in any of FIGS. 1-15.

FIG. 16 is a block diagram of a method (50) for utilizing a gaming apparatus. For example, method 50 may be applied by a game player or other user, in order to manipulate a movable gaming base or simulation apparatus 10, as described herein.

As shown in FIG. 16, method 50 comprises one or more steps or actions including, but not limited to, attaching a game piece or miniature to a base (step 51), positioning the game piece on the base (step 52), manipulating a status selector to display a selected status of the game piece (step 53), and positioning an indicator to selectively display indicia representing the selected status (step 54). Depending on application, method 50 may also include allocating comparative levels between the selected status and a complementary status (step 55), manipulating a second status selector (step 56), manipulating a rotary display (step 57), and placing a token on the base (step 58). These steps may be performed in any order or combination, with or without additional gaming or simulation activities, as described herein, and as known in the art.

Attaching a game piece (step 51) may be performed to selective coupling a game piece or miniature to the movable base. For example, a game piece can be coupled to a support member having a first end configured to support the game piece in position with respect to the gaming area or simulation environment, and a second end attached to the base. Alternatively, the game piece can be directly attached to the base, without additional support structures. Typically, the selected game piece or miniature can be swapped in and out using a decouplable attachment, but the game piece and base can also be permanently attached, or formed as a unit.

Positioning the base (step 52) may be performed to move the game piece into a particular location with respect to the gaming area, or within a simulation environment, with the game piece supported in position on the base. Alternatively, the base and game piece may positioned in a stationary location, and another action may be taken, as defined by the gaming or simulation architecture (e.g., firing a weapon, raising shields, cloaking or other offensive or defensive action, communications or other engineering function, holding in place, or awaiting an opportunity action).

Selecting a status (step 53) is performed by manipulating a status selector on the base, in order to display the selected status. The status itself represents a state or condition of the game piece with respect to the gaming or simulation environment, based on a corresponding architecture or set of rules. The status selector may include a sliding indicator extending through the base from a first side to a second side, with a set of indicia configured for selective display and concealment in order to indicate the selected status.

Positioning the indicator (step 54) encompasses sliding, moving, or otherwise manipulating the indicator with respect to the first and second sides of the base, in order selectively display at least one of the indicia. For example, an individual index or subset of the indicia may be selectively displayed on a first side of the base, and another index or subset of the indicia may be selectively concealed on a second side of the base. The selectively displayed indicia represent the selected status of the game piece, while the other (concealed) indicia represent a different status, which is not selected (that is, a status other than the selected status).

The user or gamer can also allocate or apportion degrees or comparative levels related to the selected status (step 55). For example, a multi-state indicator may be positioned to selectively display a plurality of the indicia on either first or second side of the base, where the plurality of indicia represent a comparative level of the selected status (e.g., high, low, medium; level one, two three, etc.). A fixed or total value of the comparative levels can also be allocated or apportioned between the selected status and a complementary status, for example representing front and rear shields or other defensive systems, or different offensive, defensive, and engineering status categories.

In these applications, the indicator can also be positioned to selectively display at least one other indicia on the second side of the base, representing the comparative level of the complementary status. The comparative levels of the selected and complementary status features can be conserved, with selected indicia displayed on the first and second sides of the base to represent a fixed total comparative value or level, available in aggregate for apportionment between the selected status and the complementary status.

In some devices, a second status may also be selected (step 56), for example using two transversely oriented indicators. Both binary and multi-state indicators are contemplated, in any order or combination. For example, generally oblong and planar sliding indicators may be positioned in transversely oriented channels, formed in one or both of the upper and lower portions of the base. A slotted arrangement can be utilized to retain the selectors within the base, and to limit motion with respect to the sides of the base.

Other actions may include rotating a display (step 57) to provide additional status information, for example by indicating offensive or defensive strength, energy, power, level, or other information related to the gaming architecture or simulation environment. Depending on design, a rotary display can be provided on the top of the base, for example using a pointer to indicate selected indicia, which represent the additional status information.

A token or additional game piece can also be placed on the base (step 58), for example using a token holder coupled to the pointer or support structure. The token can represent additional status information, for example cargo, or to indicate the presence of a passenger, commander or other gaming character or simulation entity. Tokens can also be used to represent any of the more general status information related to the gaming or simulation architecture, as described herein.

In each of these examples and embodiments, the disclosed base and selector configurations are designed to provide substantial advantages. In particular, the base can be configured for positioning the game piece and selecting the status in a continuous fashion, with one hand, including positioning the indicator with respect to the sides of the base. For example, the base can be positioned with two or three fingers on the upper or lower portion, while the thumb is used to position the indicator into a flush relationship with respect to the side of the base. Alternatively, a thumb and opposing finger (or opposing fingers) can be used to toggle the indicator back and forth between binary states indicate at opposing sides of the base, or to move the indicator into an intermediate position representing apportionment of status levels or comparative degrees between complementary states.

These designs provide additional advantages over other systems that require two hands or additional manipulation steps, as known in the art. Integration of one or more status selectors into the apparatus also provides for substantially easier manipulation, with options to selectively conceal display and conceal one or more indicia on either side of the base. The status selectors are also configured for manipulation in a single action, simultaneous with moving or positioning the base, in order to speed gaming and provide an improved simulation experience.

While this invention has been described with reference to exemplary embodiments, it will be understood by those skilled in the art that various changes can be made and equivalents may be substituted, without departing from the spirit and scope of the invention. In addition, modifications may be made to adapt the teachings of the invention to particular situations and to use other materials, without departing from the essential scope thereof. The invention is thus not limited to the particular examples that are disclosed here, but encompasses all of the embodiments falling within the scope of the claims.

The invention claimed is:

1. A gaming apparatus comprising:

a base configured to position a game piece with respect to a gaming area;

a coupling member configured to couple the game piece to the base;

a status selector configured to select a status of the game piece, the status selector comprising a sliding indicator extending from a first side of the base to a second side of the base; and a set of indicia on the sliding indicator, wherein the indicia are configured to be selectively displayed by positioning the sliding indicator with respect to the first and second sides of the base, such that the selected status is indicated;

wherein the sliding indicator has indicia at each end and is inserted into a slot or channel extending through the base along a longitudinal axis so that a portion of the sliding indicator extends outside the base to selectively display at least one of the indicia representing the selected status of the game piece on the first side of the base, and wherein at least one other of the indicia is selectively concealed on the second side of the base.

2. The apparatus of claim 1, wherein a plurality of the indicia representing a comparative level of the selected status are selectively displayed on the first side of the base.

3. The apparatus of claim 2, wherein at least one other of the indicia is selectively displayed on the second side of the base to indicate a comparative level of a complementary status of the game piece, and wherein the comparative levels of the selected status and the complementary status represent a fixed total value attributable between the selected status and the complementary status.

4. A gaming apparatus comprising:

a base configured to position a game piece with respect to a gaming area;

a coupling member configured to couple the game piece to the base;

a status selector configured to select a status of the game piece, the status selector comprising a sliding indicator extending from a first side of the base to a second side of the base;

a set of indicia on the sliding indicator, wherein the indicia are configured to be selectively displayed by positioning the sliding indicator with respect to the first and second sides of the base, such that the selected status is indicated; and a second sliding indicator extending through the base in a transverse orientation with respect to the first and second sides, the second sliding indicator having a second set of indicia configured for selective display by positioning the second sliding indicator with respect to third and fourth sides of the base, respectively.

5. The apparatus of claim 1, further comprising a pin extending axially through a slot in the sliding indicator, the pin configured to retain the sliding indicator within the base and the slot dimensioned to limit motion of the sliding indicator with respect to the first and second sides, respectively, while retaining the sliding indicator within the base when the pin contacts or abuts either end of the slot.

6. The apparatus of claim 1, wherein the coupling member comprises a support having a first end coupled to the base and a second end extending therefrom, the second end configured to support the game piece in position above the gaming area with the pin on a lower portion of the support.

7. The apparatus of claim 1, further comprising a channel extending through the base from the first side of the base to the second side of the base along a longitudinal axis, the channel configured to accommodate the sliding indicator within the base to position the sliding indicator in either direction along the axis, in order to selectively display and conceal one or more of the indicia on each end.

8. The apparatus of claim 7, wherein the channel is open at a top of the base and further comprising a rotary display disposed over the sliding indicator and above the top of the base.

9. The apparatus of claim 1, wherein the sliding indicator has a substantially oblong and planar configuration with first and second ends substantially conforming to the first and second sides of the base, respectively, such that the first and seconds ends of the sliding indicator are alternately positionable in a substantially flush relationship thereto.

10. A gaming or simulation apparatus comprising:

a base configured to position a game piece with respect to a gaming area;

a support member having a first end coupled to the base and a second end configured to support the game piece in position above the gaming area;

a status selector configured to select a status of the game piece with respect to the gaming area, the status selector comprising a sliding status indicator extending from a first side of the base to a second side of the base; and a set of indicia on the sliding status indicator, wherein the indicia are configured to be selectively displayed by manually positioning the sliding status indicator with respect to the first and second sides of the base, such that at least one of the selectively displayed indicia indicates the selected status of the game piece;

wherein the sliding status indicator has indicia at each end and is inserted into a slot or channel extending through the base along a longitudinal axis so that a portion of the sliding status indicator extends outside the base to selectively display the at least one of the indicia representing the selected status of the game piece on the first side of the base, and wherein at least one other of the indicia is selectively concealed on the second side of the base.

11. The apparatus of claim 10, wherein a plurality of the indicia are selectively displayed on the first side of the base to indicate a comparative level of the selected status, and wherein at least one other of the indicia is selectively displayed on the second side of the base to indicate a comparative level of a complementary status of the game piece.

12. The apparatus of claim 11, wherein the comparative levels of the selected status and the complementary status represent a fixed total value, the fixed total value attributable between the selected status and the complementary status by positioning the status indicator with respect to the first and second sides of the base.

13. A gaming or simulation apparatus comprising:

a base configured to position a game piece with respect to a gaming area;

a support member having a first end coupled to the base and a second end configured to support the game piece in position above the gaming area;

a status selector configured to select a status of the game piece with respect to the gaming area, the status selector comprising a status indicator extending from a first side of the base to a second side of the base;

a set of indicia on the status indicator, wherein the indicia are configured to be selectively displayed by manually positioning the status indicator with respect to the first and second sides of the base, such that at least one of the selectively displayed indicia indicates the selected status of the game piece; and a second status selector positioned in transverse relationship with respect to the first and second sides, the second status selector comprising a transverse status indicator having a second set of indicia configured for selective display and concealment at third and fourth sides of the base, respectively.

14. The apparatus of claim 13, wherein the support extends through a slot in the status indicator and into a bottom portion of the base, the slot dimensioned to limit motion of the status indicator with respect to the first and second sides of the base, respectively.

15. A method comprising:

positioning a game piece with respect to a gaming area, the game piece supported on a base; and manipulating a status selector to display a selected status of the game piece with respect to the gaming area, the status selector comprising a sliding indicator extending through the base from a first side of the base to a second side of the base;

wherein the sliding indicator is manually positioned to selectively display at least one of the indicia indicating the selected status of the game piece on the first side of the base, and to selectively conceal at least one other of the indicia on the second side of the base;

wherein positioning the game piece and manipulating the status selector are performed in continuous fashion with one hand, and further comprising manipulating the status selector to position the sliding indicator in either direction along an axis to selectively display and conceal one or more of the indicia on each end.

16. The method of claim 15, further comprising selectively attaching the game piece to the base by coupling the game piece to a support member having a first end configured to support the game piece and a second end attached to the base.

17. The method of claim 16, further comprising manually positioning the sliding indicator to selectively display a plurality of the indicia on the first side of the base, wherein the plurality of indicia represent a comparative level of the selected status.

18. The method of claim 17, further comprising allocating a fixed total value of the comparative levels between the selected status and a complementary status of the game piece, wherein the sliding indicator is positioned to selectively display at least one other of the indicia on the second side of the base, the at least one other indicia representing a comparative level of the complementary status and the comparative levels of the selected status and the complementary status representing the fixed total value in aggregate.

* * * * *